United States Patent [19]

Siegel et al.

[11] 4,251,026

[45] Feb. 17, 1981

[54] ATTIC VENTILATION CONTROL SYSTEM

[75] Inventors: Howell T. Siegel; Jeffrey I. Siegel, both of Fort Worth; Richard E. Shank, Mineral Wells, all of Tex.

[73] Assignee: Butler Ventamatic Corp., Mineral Wells, Tex.

[21] Appl. No.: 966,651

[22] Filed: Dec. 5, 1979

[51] Int. Cl.[3] ..... F24F 7/02

[52] U.S. Cl. ..... 236/49; 98/43 A; 236/46 R; 417/12; 417/17; 417/32

[58] Field of Search ..... 236/49, 46 R; 98/43 A, 98/43 PS; 417/32, 12, 17

[56] References Cited

U.S. PATENT DOCUMENTS

| | | | |
|---|---|---|---|
| 2,095,824 | 10/1937 | McMahan | 417/32 X |
| 2,542,763 | 2/1951 | Frisk | 236/46 X |
| 2,770,995 | 11/1956 | Lundstrum | 98/43 A X |
| 2,835,779 | 5/1958 | Kazan | 219/20 |
| 3,307,469 | 3/1967 | Bohanon | 98/43 A X |
| 3,739,980 | 6/1973 | Andersen | 236/49 |
| 3,753,184 | 8/1973 | Holloway et al. | 236/47 |
| 3,934,797 | 1/1976 | Perlmutter | 236/49 X |
| 3,951,336 | 4/1976 | Miller et al. | 236/49 X |
| 3,965,691 | 6/1976 | Van Huis | 98/30 X |

*Primary Examiner*—Albert J. Makay
*Assistant Examiner*—William E. Tapolcai, Jr.
*Attorney, Agent, or Firm*—Fleit & Jacobson

[57] ABSTRACT

A control system for use with an attic ventilation fan operates to reduce heat buildup during the summer months and also to prevent frost buildup during the winter months by eliminating the cold, moisture-laden, air from the attic. A summer control unit is provided to eliminate the hot air and a winter control unit operates without the need of a humidistat to evacuate the moisture laden cold air during the winter months.

8 Claims, 4 Drawing Figures

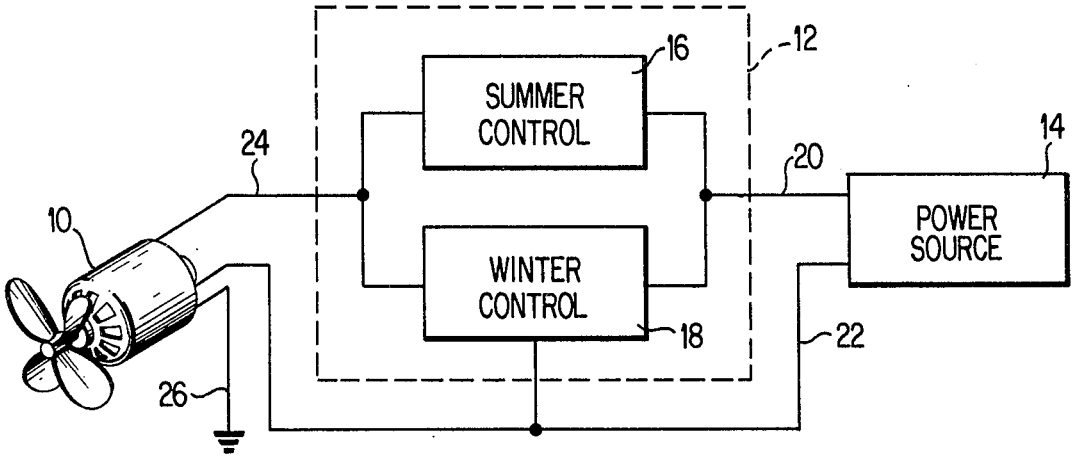
FIG. 1
FIG. 2
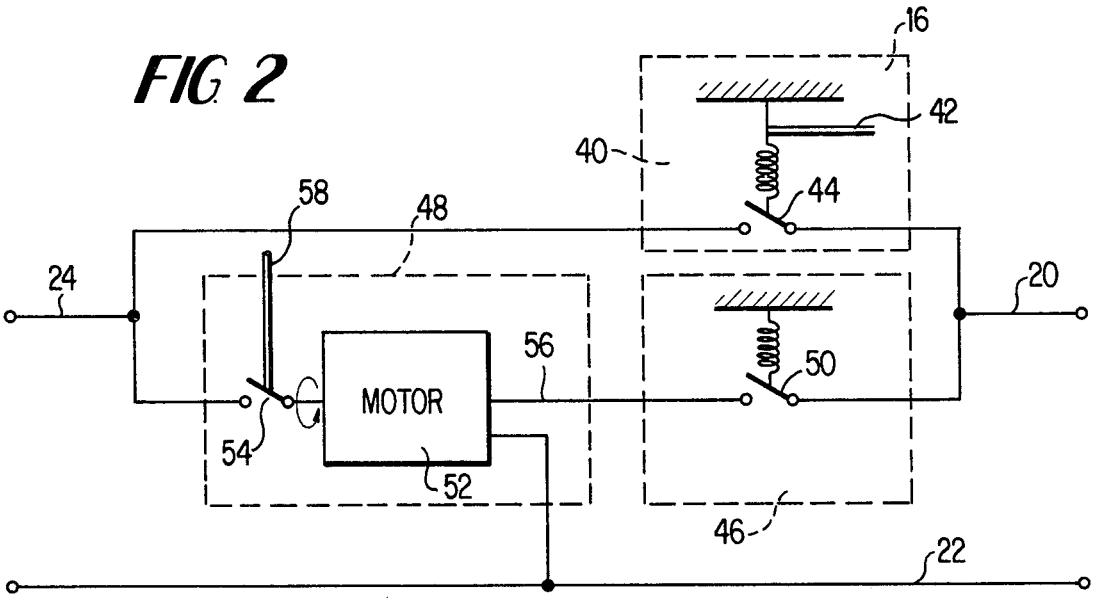

ATTIC VENTILATION CONTROL SYSTEM

BACKGROUND OF THE INVENTION

The present invention relates to ventilator control systems and more specifically relates to the continuous control of an attic ventilation fan.

The advantages of ventilating the attic space above a dwelling have been known for a long time and it is often been the practice to provide wind-operated ventilators or the like to evacuate the air from the attic. More recently, thermostatically controlled power ventilators have been utilized which employ a thermostatically controlled electric fan to evacuate the air. Such power ventilators may be located at the end of the attic at the eaves or simply located in the middle of the roof with flashing providing a suitable weather shield for the hole made in the roof. It is, of course, advantageous to evacuate the super-heated air in the attic during the summer months, since it is quite common that temperatures in certain parts of the United States may reach up to 160° F. in the attic space. Regardless of the amount and type of insulation employed in the attic, hot air will eventually penetrate through the insulation and cause the heat to build up in the living space. This ultimately causes an air conditioning system to operate for a longer length of time in an attempt to compensate for this heat or, in the event that no air conditioning is present, the living space will quickly become quite unpleasant.

However, in many sections of the country the temperature does not remain warm all year long and in fact quite frequently drops to at least below freezing in 75% of the country. Such conventional attic ventilation systems are then, of course, not usable during these cold months. Typically what happens during the winter months is that the moisture laden air inside the attic will cause ice to build up both inside and outside the attic. The ice build up inside the attic creates several problems since it typically forms on rafters and on any metallic parts such as nails, nail plates, or the like. Moreover, in temperate zones where the temperature during the winter does not stay below freezing but periodically goes to freezing and then rises to a relatively warmer daytime temperature, after a period of several cycles of such freezing and defrosting of the ice accumulation on the roofing nails, the expansion and contraction of the ice will loosen the roofing nails to such an extent that their holding power is minimized. Additionally, as the ice melts inside the attic, the water droplets cause additional problems since they may fall either onto the bare ceiling floor or onto insulation placed in the attic floor. Of course, should the insulation become wet or damp its effectiveness and life are considerably shortened. Furthermore, if the moisture is absorbed in the wood of the attic it may lead to rot, peeling paint, cracking plaster, and the like.

BRIEF SUMMARY OF THE INVENTION

The present invention provides a control which activates power attic vents so that they can operate under both summer climatic conditions and also under winter climatic conditions. A thermostat is provided to control the power attic vent during the summer months and such thermostat is typically of the "off" type having a tolerance band such that upon reaching a predetermined temperature the thermostat cuts off and then cuts on again at a point which lies outside of the tolerance band.

The present invention provides a control system for also utilizing the power attic vent in the winter months in order to evacuate the moisture-laden air from the attic space. The present invention accomplishes this without the need of a humidistat. However, the attic fan is not simply controlled by a thermostat, since upon the temperature reaching or dropping to a predetermined temperature, the attic fan would continuously run. This is obviously not a desirable situation, especially in colder climates, where the temperature will oftentimes stay low for extended periods of time. Moreover, merely controlling the attic power vent by a humidistat in order to eliminate the buildup of moisture-laden air does not present a satisfactory solution since conventional humidistats employ some sort of sensor, such as a hair or the like, which expands and contracts relative to the extent of humidity in the air. The sensor then operates electrical contacts to provide the humidistat function. However, when subjected to freezing temperatures the conventional humidistat quite frequently freezes up and not only can become non-functional but also may be forced into an uncalibrated state, upon which no reliance can be made.

Therefore, it is an object of the present invention to provide a system for controlling an attic power vent which is operable the entire year around.

It is another object of the present invention to provide a control system for an attic power vent which does not employ a humidistat.

It is another object of the present invention to provide a power attic vent control system which operates to eliminate moisture laden air during freezing temperatures without continuously running the attic vent.

The manner in which these and other objects are accomplished by the present invention will become apparent from the following detailed description of the preferred embodiment.

BRIEF DESCRIPTION OF THE DRAWINGS

FIG. 1 is a block diagram of the inventive control system;

FIG. 2 is a block diagram of a portion of the inventive control system of FIG. 1;

DETAILED DESCRIPTION OF THE PREFERRED EMBODIMENT

Figure 4:
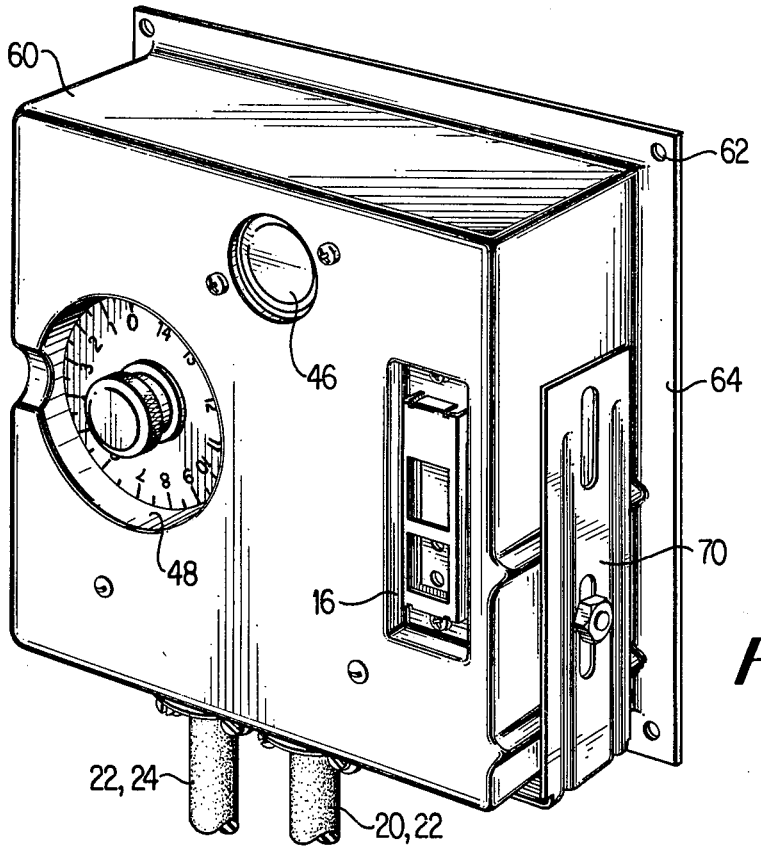
FIG. 4 is a perspective view of the case of FIG. 3.

Referring now to FIG. 1, a conventional attic ventilation fan 10 is connected to the inventive system shown contained within the dashed lines at 12. Fan 10 is connected through the invention 12 to the required power source 14. The inventive control system 12 utilizes a summer control system 16 and a winter control system 18 which are connected to the power source by conductors 20 and 22. The output of the control system 12 is then connected to the fan 10 via line 24. The fan must be installed in accordance with local building codes and should be grounded at 26 in order to prevent electrical hazards.

Referring now to FIG. 2, the inventive control unit 12 is shown in more detail. The summer control 16 is seen to comprise an "off-type" thermostat 40. The "off-type" thermostat is one which turns off at a temperature which has been preset and then turns back on at a point somewhere above the preselected setting, typically about 15° above the setting. The "off-type" thermostat 40 is provided with an adjustment means 42 which will allow the preset temperature to be adjusted from 60° to 120° F. Accordingly, in the case where the thermostat is set at 80° F. and there is a 15° differential, then the thermostat will turn on at 95° F., thereby activating the fan 10 by connecting it through lines 24 and 22 to the power source. As the temperature in the attic is caused to decrease either by the evacuation of the superheated air or by natural lowering of the temperature during the day, as the temperature drops to 80°, which was the preselected temperature, the "off-type" thermostat 40 will actuate switch 44 and open the line to the fan, thereby cutting off its power. The thermostat is of the adjustable type and an adjustable lever or the like shown schematically at 42 permits the tension in the bi-metal strip or spring to be varied, thereby presetting the temperature at which the switch means 44 of the "off-type" thermostat will close.

In the winter months the apparatus 18 which controls the frost cycle takes over the control of the fan 10. The winter control unit 18 comprises two main elements, a thermostat 46 and a timer 48. As mentioned above, due to the manner in which a humidistat operates, the actuating filament or hair will freeze when the temperature drops below 32° F., therefore its usefulness in controlling the fan is extremely limited. The thermostat 46 is of the "on-type", which means that as the temperature drops and reaches a preselected point, a switch 50 will be closed; thereby activating the timer by connecting it to power line 20, the timer already being connected to the other power line 22. The percentage timer employs a motor 52 and a switch 54. As the motor is energized by the voltage on line 56, a cam or the like acts to rotate one of two switch contacts of switch 54 so as to contact, thereby closing switch 54 and connecting line 56 through the thermostat 46 to line 24. In this manner the fan is energized by the power on line 24.

As indicated above, the timer 48 is a percentage-type timer and which typically is adjustable by the means shown diagrammatically at 58 so as to have between 0 and 15 minutes run time. It is, of course, understood however that other intervals are possible. As will be seen in the subsequent figures, the percentage timer is controllable, hence, if the timer is a 15 minute percentage timer and it is set to run for 3 minutes at the point when the temperature drops below the preselected temperature set in thermostat 46, then the motor 52 will be energized and the switch 54 closed for only 3 minutes thereby providing power to the attic fan for only that time. After the three-minute run phase is completed, the timer will shut off or open the line for 12 minutes, thereby completing the 15 minute cycle. Accordingly, in one hour the timer would cycle 4 times, and run the fan for a total of 12 minutes with a total shut off time of 48 minutes. This, of course, is necessary since in cold climates the temperature may remain below the preselected temperature for a considerable length of time and since the present invention is provided to eliminate moisture laden air but is not controlled by the humidity, it is necessary to provide this type of fan control so as to effectively control humidity without sensing it. Nevertheless, it should be noted that in climates such as in the South or Southeastern United States, where a high humidity is present but very little frost since there are very few times when the temperature drops below freezing, a humidistat could be utilized. In such areas although freezing rarely occurs the need still exists to get rid of the excessive moisture which builds up during temperature drops which are well below those which could be controlled by the summer control 16.

Figure 3:
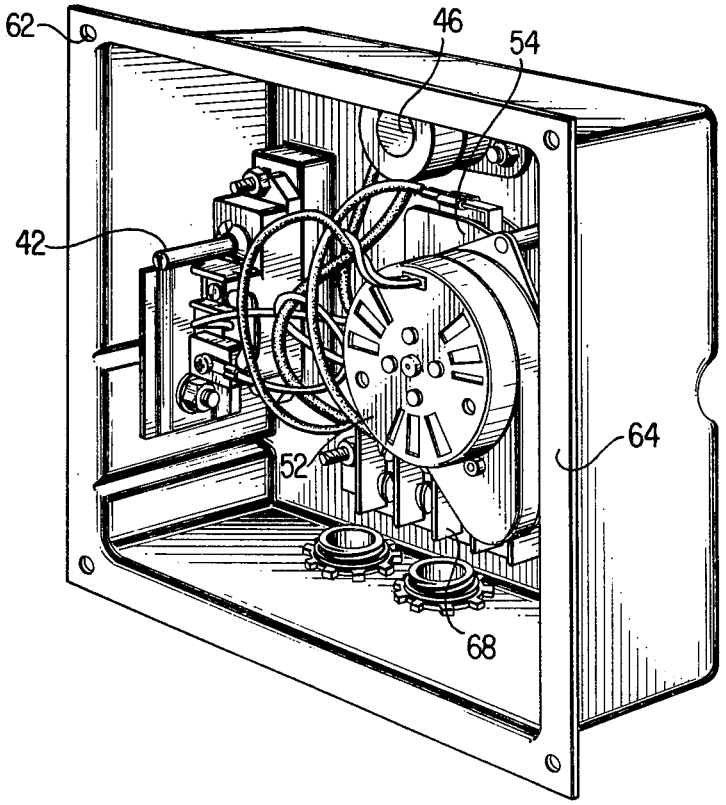
FIG. 3 is a perspective view of the inventive control system mounted in a suitable case.

Referring now to FIGS. 3 and 4, the inventive control system is shown contained within a seamless, injection-molded, plastic housing 60, which may be formed of ABS plastic or any other durable plastic. It is pointed out that the enclosure 60 may also be made of any suitable metal, such as steel, or aluminum, or the like. Although it is not shown, a cover is provided which will seal the unit and can be attached using the four holes, shown typically at 62. Screws, rivets, or the like may be used to secure the cover to the face 64 of the casing 60. In this regard, an aperture must be provided in the cover to permit the control shaft 66 of the adjustable thermostat 40 to protrude therethrough, so as to permit adjustment of the thermostat.

The power cables are fed into the housing at 14 and the connections may be made to a terminal block 68. The conductors for the fan 10 are shown exiting the case at 24 and 26, which are also connected to the terminal block 60.

Means for mounting the assembly may be provided by the slotted piece of strip steel shown at 70.

It is of course understood that various other embodiments of the inventive apparatus may also be provided. For example, a manual override switch may be provided to bypass completely the thermostatic controls of the fan and, in this case, the fan may simply be operated on a manual basis by such switch.

Accordingly, it is understood that the foregoing description is presented by way of example only and is not intended to limit the scope of the present invention, except as provided in the claims appended hereinbelow.

We claim:

1. A control system for controlling an electrically powered exhaust fan over a broad range of summer and winter temperature conditions, said control system coupling the exhaust fan with an electrical power source, said control system comprising:

a first thermostatic control means for electrically coupling said electrical power source to said exhaust fan without periodic interruption when the temperature exceeds a first predetermined temperature;

a second thermostatic control means for periodically electrically coupling said electrical power source to said exhaust fan only when the temperature falls below a second predetermined temperature, said second thermostatic control means comprising a thermostat, an electrically-powered percentage timing means for repetitively timing a preselected time interval in a predetermined time period, said thermostat coupled with said percentage timing means to provide electrical power from said electrical power source to said percentage timing means only when the temperature falls below said second predetermined temperature, and means for coupling said percentage timing means to said exhaust fan to electrically couple said exhaust fan to said electrical power source during said preselected time interval.

2. A control system as claimed in claim 1, wherein said first thermostatic control means comprises an "off-type" thermostat which turns "off" at said first predetermined temperature to decouple said electrical power source from said exhaust fan.

3. A control system as claimed in claim 1, wherein said thermostat of said second thermostatic control means comprises an "on-type" thermostat which turns "on" at said second predetermined temperature to couple said electrical power source to said percentage timing means.

4. A control system as claimed in claim 1, wherein said first and second thermostatic control means are encased within a unitary enclosure.

5. Apparatus for ventilating a closed area subject to a broad range of summer and winter temperature conditions to evacuate hot air in the closed area to cool the closed area, and to evacuate moisture-laden cold air in the closed area to avoid ice and moisture accumulation in the closed area, the apparatus comprising:

an electrically powered fan means for drawing air from within a closed area to the outside of a closed area;

an electrical power source for providing electrical power to said fan means to operate same;

hot air evacuation control means for controlling the evacuation of hot air from said closed area, said hot air evacuation control means comprising a first thermostatic control means for electrically coupling said electrical power source to said fan means without periodic interruption when the temperature in the closed area exceeds a first predetermined temperature;

moisture-laden cold air evacuation control means for controlling the evacuation of cold air from said closed area, said cold air evacuation control means comprising a second thermostatic control means for periodically electrically coupling said electrical power source to said fan means only when the temperature falls below a second predetermined temperature, said second thermostatic control means comprising a thermostat, an electrically-powered percentage timing means for repetitively timing a preselected time interval in a predetermined time period, said thermostat coupled between said electrical power source and said percentage timing means to provide electrical power from said electrical power source to said percentage timing means only when the temperature falls below said second predetermined temperature, and means for coupling said percentage timing means to said fan means to electrically couple said fan means to said electrical power source during said preselected time interval.

6. Apparatus as claimed in claim 5, wherein said first thermostatic control means comprises an "off-type" thermostat which turns "off" at said first predetermined temperature to decouple said electrical power source from said fan means.

7. Apparatus as claimed in claim 5, wherein said thermostat of said second thermostatic control means comprises an "on-type" thermostat which turns "on" at said second predetermined temperature to couple said electrical power source to said percentage timing means.

8. Apparatus as claimed in claim 5, wherein said first and second thermostatic control means are encased within a unitary enclosure.

* * * * *